US009199241B2

(12) United States Patent
Bodurov et al.

(10) Patent No.: US 9,199,241 B2
(45) Date of Patent: Dec. 1, 2015

(54) GRINDING BODY

(75) Inventors: Petar Bodurov, Sofia (BG); Todor Penchev, Sofia (BG)

(73) Assignees: ASSAREL-MEDET AD, Panagyurishte (BG); TODOR PENCHEV, Sofia (BG); PETAR BODUROV, Sofia (BG)

( * ) Notice: Subject to any disclaimer, the term of this patent is extended or adjusted under 35 U.S.C. 154(b) by 124 days.

(21) Appl. No.: 13/879,467

(22) PCT Filed: Oct. 11, 2011

(86) PCT No.: PCT/BG2011/000019

§ 371 (c)(1),
(2), (4) Date: Apr. 15, 2013

(87) PCT Pub. No.: WO2012/048391

PCT Pub. Date: Apr. 19, 2012

(65) Prior Publication Data

US 2014/0191069 A1 Jul. 10, 2014

(30) Foreign Application Priority Data

Oct. 13, 2010 (BG) ..... 110769

(51) Int. Cl.
*B02C 17/20* (2006.01)

(52) U.S. Cl.
CPC ..... *B02C 17/20* (2013.01)

(58) Field of Classification Search
CPC ..... B02C 17/20; B02C 17/205
USPC ..... 241/184
See application file for complete search history.

(56) References Cited

U.S. PATENT DOCUMENTS 1,431,475 A * 10/1922 MacDonald ..... 241/184

FOREIGN PATENT DOCUMENTS

| | | |
|---|---|---|
| CN | 201 049 309 Y | 4/2008 |
| GB | 430 471 A | 6/1935 |
| GB | 471 180 A | 8/1937 |

*Primary Examiner* — Mark Rosenbaum
(74) *Attorney, Agent, or Firm* — Ladas & Parry LLP

(57) ABSTRACT

The invention relates to a grinding body for crushing and grinding of ores rocks or earth, inert and all other materials, in drum and other mills. It finds application in ore enrichment, production of construction materials, waste processing and other industrial branches. The grinding body comprises a spheroidal cone, whose forming curve is part of a circle or of some other geometrical curve and a vertex, and a base which is part of a sphere or of other three-dimensional figure, obtained by rotation of geometrical curves and an edge between them. In one of the versions the cone and the base are connected by a cylinder. For better producibility of the grinding body, a flat spot with circular or other shape is made on the surface of the base. In another version the flat spots are made on the surface of the cone and on the surface of the cylinder between the base and the cone. In a subsequent version the vertex of the cone is cut flat with its plane perpendicular or inclined towards the axis of the body. In other versions, more or less convex peripheral rings are made between the cone and the base. The cross section of these rings has the shape resembling a circle, a triangle or a rectangle. In a subsequent version on the base and on the flat cut vertex short cylinders with flat bases are protruding. All edges and the vertex of the body may be rounded along part of a circle, spiral or other geometrical figure. The grinding body has greater area than the spherical grinding body and greater density in a given space. The existence of an edge and a vertex increases milling productivity.

13 Claims, 8 Drawing Sheets

GRINDING BODY

RELATED APPLICATION INFORMATION

This application is a 371 of International Application PCT/BG2011/000019 filed 11 Oct. 2011 entitled "Grinding Body", which was published in the English language on 19 Apr. 2012, with International Publication Number WO 2012/048391 A2, and which claims priority from Bulgaria Patent Application 110769, filed 13 Oct. 2010, the content of which is incorporated herein by reference.

FIELD OF THE INVENTION

The invention relates to a grinding body for fragmentation and grinding of ores, rock and earth mass and all other materials in drum- and other types of mills. It is applied in ore enrichment, production of construction materials, waste utilization and other industrial branches.

BACKGROUND OF THE INVENTION

The spherical shape grinding body for drum mills is widely known and used in practice. A disadvantage of the spherical grinding body is the low productivity of mills, slow crushing of materials because of the absence of edges and low level of stuffing of the working space.

Patents DE 440 198/1927, FR 811 408/1937, SU 1 388 088/1985, RU 2 305 597/2005 describe a grinding body of tetrahedron shape with flat or rounded faces, which have the disadvantage to be not easy and cheap for mass-production and for that reason have not been practically used yet.

An International patent application WO/2010/094091 describes a tetrahedron grinding body that overcomes the difficulties and high cost of its production.

A cubic shape grinding body is also known—U.S. Pat. No. 1,431,475/1920, which has not been used because of expensive and difficult production as well as worse milling results shown compared to the spherical grinding body.

DESCRIPTION OF THE INVENTION

The objective of the invention is to create a grinding body with a convenient shape, easy to manufacture and which quickly and efficiently crushes and grinds the feed material.

The objective is achieved through the invention of a grinding body in the shape of a spheroidal cone, whose forming curve is a part of a circle or of other geometric curve, where the base of that cone is part of a sphere or of other three-dimensional shape obtained by rotation of geometric curves. The length and radius of the cone shaping curve and the length of the base sphere curve and its radius may be equal or different.

For better producibility of the grinding body, in one of its versions, a flat spot of round or other shape is made on the base. In another version the flat spot is made on the surface of the spheroidal cone. Another version comprises a cylinder between the base and the spheroidal cone. There is a flat spot on the cylinder.

In a subsequent version the vertex of the spheroidal cone is cut flat and the plane is perpendicular or tilt down to the axis of the grinding body which passes through the vertex (before the tilt) and the centre of the body.

A subsequent version has a peripheral ring between the cone and the base, more or less convex, with a cross-section resembling a circle.

In a subsequent version the peripheral ring has a cross-section resembling a triangle. In a subsequent version the peripheral ring has a cross-section that resembles a rectangle.

In a subsequent version protruding short cylinders with flat bases are made on the base and on the cut flat vertex.

All edges of the described grinding body, their vertexes, also when cut flat, may be rounded and the roundness may be on a part of a circle, a spiral, or another geometric curve.

The grinding body may be produced from a variety of materials: metals, ceramics, stone, porcelain, glass, etc.

The main advantage of the invented grinding body is its producibility, which enables its mass production by the most widely used for these purposes technologies such as casting, stamping, forging, hot rolling, etc. Another advantage of the invented bodies is the existence of an edge, a peripheral ring or vertex, oblique or rounded, which facilitates faster crushing of bigger chunks of the milled materials. A subsequent advantage of the invented grinding body is its ability to stuff denser in a given volume because of its shape. That allows putting a greater number of grinding bodies in the same volume, which increases productivity of milling. Additionally the shape of the invented body provides greater contact area between the grinding bodies as well as between the body and the mill walls, which also improves milling. Additionally the area of the invented body is greater than the area of a sphere with the same volume and mass which increases productivity compared to the currently used spherical grinding body.

DESCRIPTION OF THE FIGURES

The invention is illustrated in details with exemplary drawings of a grinding body, which are shown in the figures included, where.

PREFERRED EMBODIMENT OF THE INVENTION

The grinding body can be produced by casting, forging or other technologies.

Figure 1:
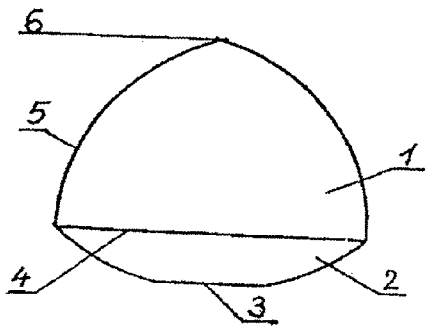
FIG. 1 represents a front view of a grinding body made of a spheroidal cone 1 with a shaping curve 5, vertex 6, base 2, which is a part of a sphere, edge 4 between the base and the cone and a flat spot 3 on the base 2.
Figure 2:
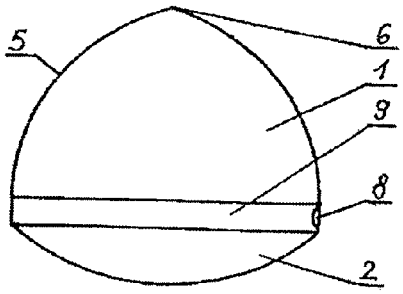
FIG. 2 represents a front view of a grinding body made of a spheroidal cone 1 and a base 2 with a flat spot 7 on the spheroidal cone.
Figure 3:
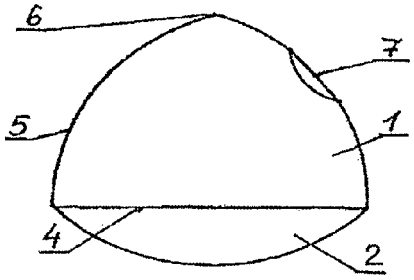
FIG. 3 represents a front view of a grinding body made of a spheroidal cone 1 and a base 2. There is a cylinder 9 with a flat spot 8 between the cone and the base.

The preferred way to produce a grinding body shown on FIG. 1, FIG. 2, and FIG. 3 is casting, which is assisted by the flat spots 3, 7 and 8, shown on the base 2, cone 1 and cylinder 9.

Figure 4:
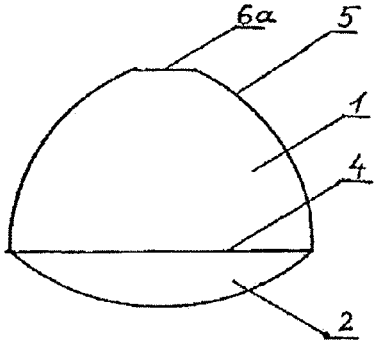
FIG. 4 represents a front view of a grinding body with a cut flat vertex 6*a* of the spheroidal cone 1.

The grinding body shown on FIG. 4 is preferably produced by casting or forging, which is assisted by the cut flat vertex 6*a* of the cone 1, with the plane perpendicular or inclined to the axis of the body.

Figure 5:
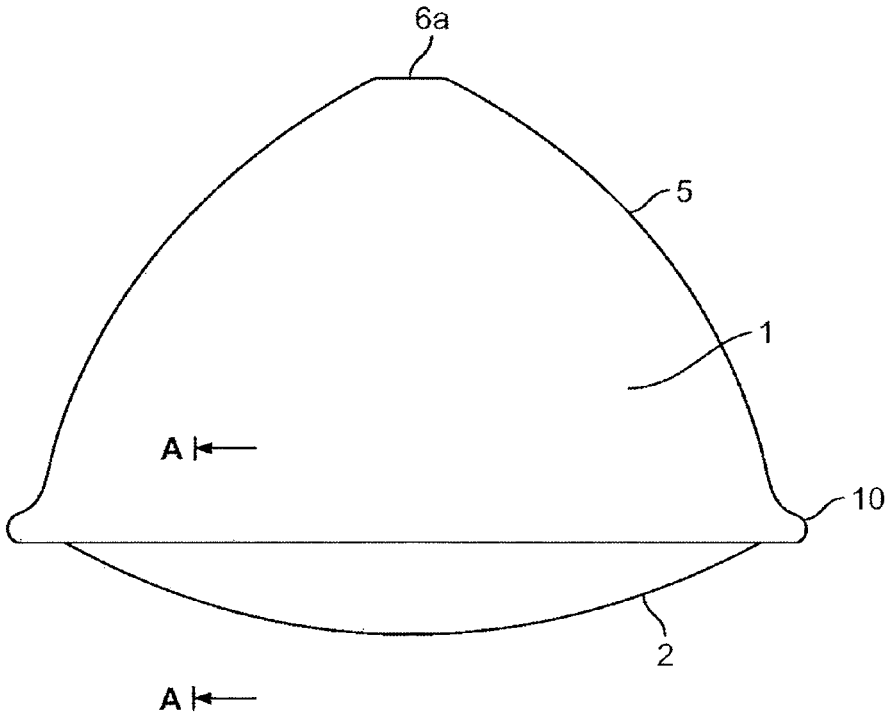
FIG. 5 represents a front view of a grinding body with a peripheral ring 10.
Figure 7:
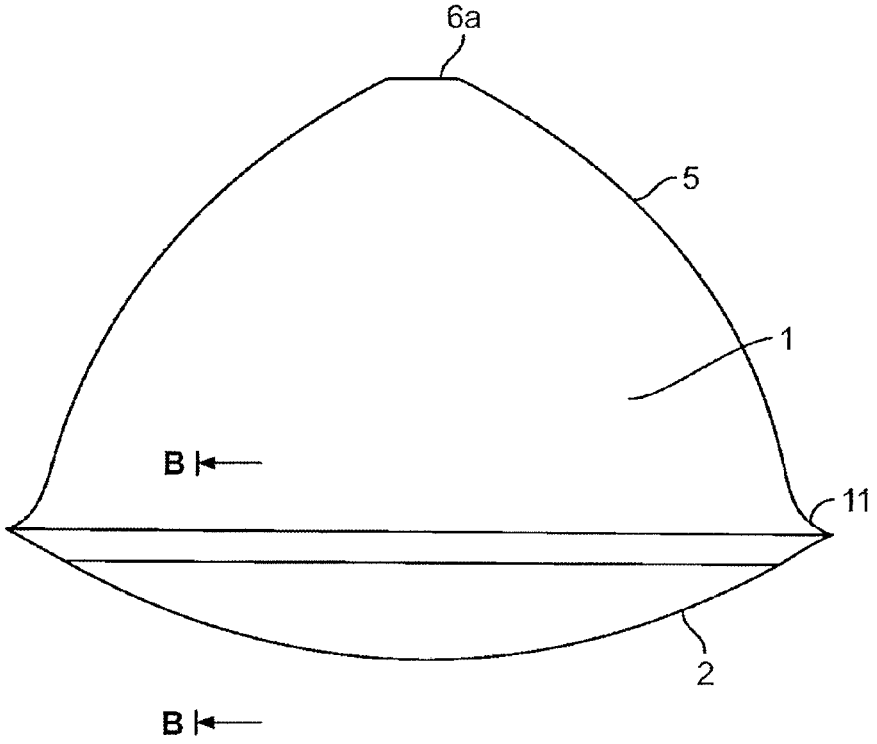
FIG. 7 represents a front view of a grinding body with a peripheral ring 11.
Figure 9:
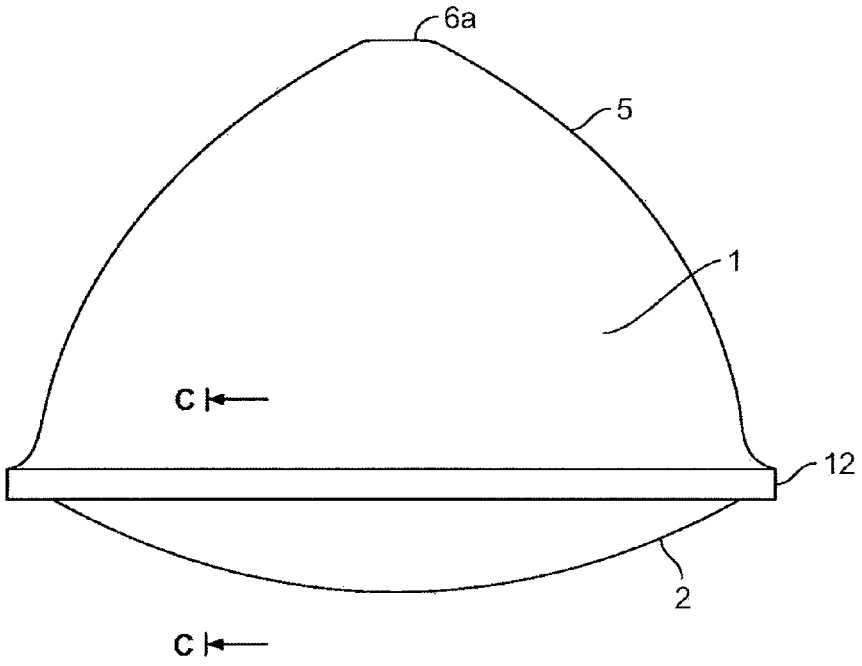
FIG. 9 represents a front view of a grinding body with a peripheral ring 12.

The preferred way of production of a grinding body shown on FIG. 5, FIG. 7 and FIG. 9 is hot forging on automatic hammers and presses. The rings 10, 11 and 12 between the cone 1 and the base 2 improve the grinding of bigger chunks of the milled materials and increase the mill's productivity.

Figure 6:
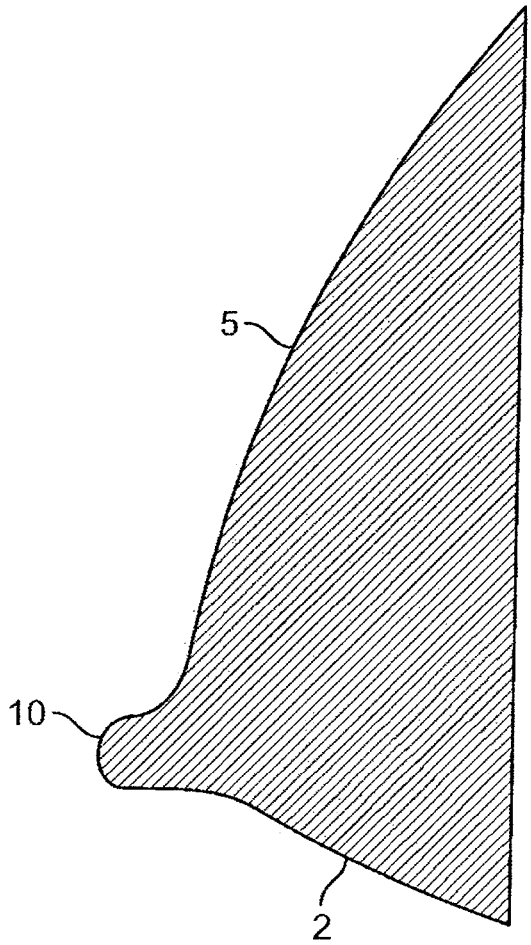
FIG. 6 represents A-A cross-section, resembling a circle, from FIG. 5, of the peripheral ring 10.
Figure 8:
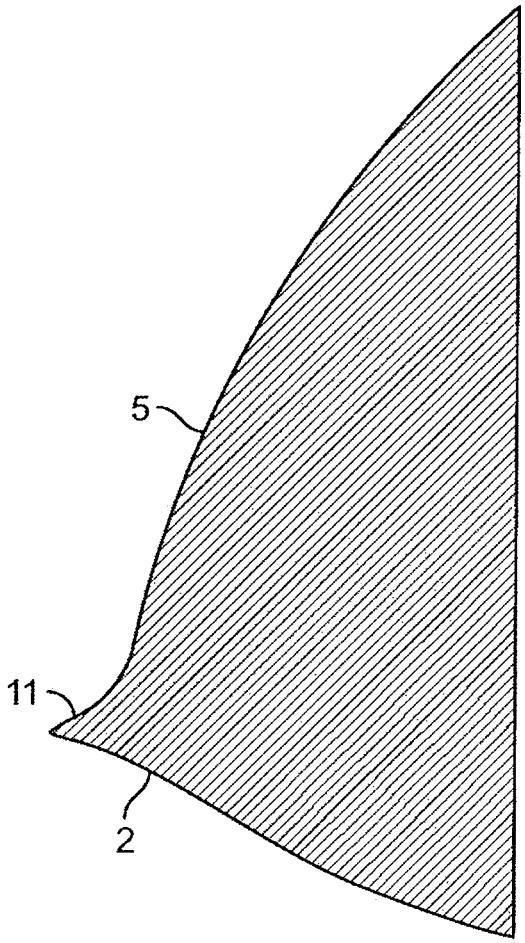
FIG. 8 represents B-B peripheral ring 11 cross section resembling a triangle, from FIG. 7.
Figure 10:
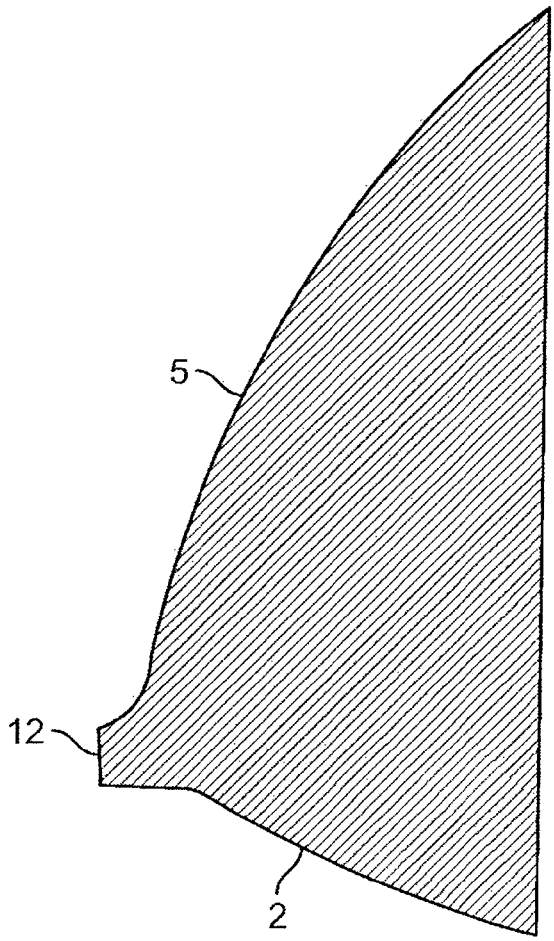
FIG. 10 represents a cross-section C-C of a peripheral ring 12, resembling a rectangle, from FIG. 9.

The peripheral rings 10, 11 and 12 on FIG. 5, FIG. 7 and FIG. 9 are made with cross sections resembling a circle in shape (FIG. 6), a triangle (FIG. 8) and a rectangle (FIG. 10), all three more or less convex to the forming arc 5 of the cone 1.

Figure 11:
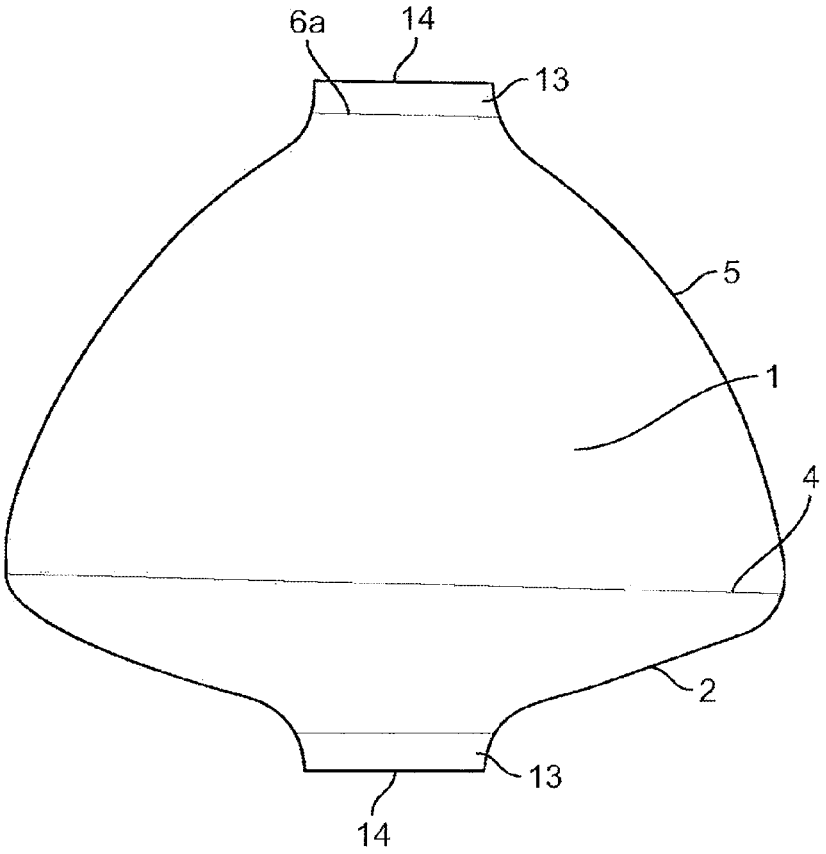
FIG. 11 represents a front view of a grinding body with protruding short cylinders 13 with flat bases 14.

The grinding body on FIG. 11 is preferably produced by rolling or radial hammering, where short cylinders 13 with flat bases 14 are made on the base 2, which is a part of a sphere, and on the cut flat vertex 6*a* of the cone 1.

The invention claimed is:

1. A grinding body comprising a spheroidal cone having a vertex, wherein the spheroidal cone is made by a 360° rotation of a convex curve, wherein the grinding body further comprises a base which is part of a sphere, wherein a peripheral ring is formed between the cone and the base, and wherein a flat spot is formed on the base.

2. The grinding body according to claim 1, wherein the convex curve forming the cone is part of a circle.

3. The grinding body according to claim 1, wherein the base of the grinding body is part of a sphere made by rotation of a geometrical curve.

4. The grinding body according to claim 3, wherein the curves forming the cone and the base are different in shape.

5. The grinding body according to claim 1, wherein the flat spot on the base has a circular shape when viewed from a perpendicular view.

6. The grinding body according to claim 1, wherein the vertex of the spheroidal cone is cut flat with its plane perpendicular or inclined to the axis of the body, wherein the axis of the body passes through the vertex before the flat cut and through the center of the body.

7. The grinding body according to claim 1, wherein the peripheral ring is a convex curve which cuts into the grinding body.

8. The grinding body according to claim 1, wherein the peripheral ring has a cross section resembling a triangle.

9. The grinding body according to claim 1, wherein the peripheral ring has a cross section resembling a rectangle.

10. The grinding body according to claim 1, further comprising protruding short cylinders with flat bases formed on the base and on the vertex.

11. The grinding body according to claim 1, wherein all edges and the vertex are rounded.

12. A grinding body comprising a spheroidal cone having a vertex, wherein the spheroidal cone is made by a 360° rotation of a convex curve, the grinding body further comprises a base which is part of a sphere, a peripheral ring is formed between the cone and the base, a flat spot is formed on the base, and the peripheral ring has a cross section resembling a triangle.

13. A grinding body comprising a spheroidal cone having a vertex, wherein the spheroidal cone is made by a 360° rotation of a convex curve, the grinding body further comprises a base which is part of a sphere, a peripheral ring is formed between the cone and the base, a flat spot is formed on the base, and the grinding body further comprises protruding short cylinders with flat bases-formed on the base and on the vertex.

* * * * *